US010405639B2

(12) United States Patent
Smith

(10) Patent No.: US 10,405,639 B2
(45) Date of Patent: Sep. 10, 2019

(54) COSMETIC ORGANIZER

(71) Applicant: Danielle Smith, Miami, FL (US)

(72) Inventor: Danielle Smith, Miami, FL (US)

( * ) Notice: Subject to any disclaimer, the term of this patent is extended or adjusted under 35 U.S.C. 154(b) by 1199 days.

(21) Appl. No.: 14/071,778

(22) Filed: Nov. 5, 2013

(65) Prior Publication Data

US 2015/0122287 A1 May 7, 2015

(51) Int. Cl.
*A45D 40/00* (2006.01)
*A45D 44/00* (2006.01)

(52) U.S. Cl.
CPC ..... *A45D 44/00* (2013.01)

(58) Field of Classification Search
CPC ..... A45D 40/00; A45D 40/18; A45D 44/18; A45D 40/22; A45D 40/24; A45C 11/008; A45C 13/002; A45C 3/00; A44B 18/003; A44B 18/0096
See application file for complete search history.

(56) References Cited

U.S. PATENT DOCUMENTS 4,461,332 A 7/1984 Parkhurst
4,736,955 A * 4/1988 Pollock ..... 273/336
5,242,063 A 9/1993 Erickson et al.
5,680,928 A * 10/1997 Carr ..... 206/6.1
6,189,698 B1 * 2/2001 Asser ..... 206/581
6,241,388 B1 6/2001 Terramani
6,561,240 B2 5/2003 Ma
6,688,316 B1 2/2004 Klug
6,739,345 B2 5/2004 Stanley
6,820,744 B2 11/2004 Hoffman
7,181,811 B1 * 2/2007 Tomanek et al. ..... 24/442
7,854,317 B1 12/2010 Hebert et al.
7,946,425 B2 5/2011 Burnett
8,225,829 B2 7/2012 Melamed
2002/0090265 A1 * 7/2002 Merten ..... 405/18
2005/0074740 A1 * 4/2005 Armstrong ..... 434/428
2005/0136214 A1 * 6/2005 Most ..... 428/100
2006/0000043 A1 * 1/2006 Jou-Chen et al. ..... 15/231

OTHER PUBLICATIONS

U.S. Appl. No. 13/659,951, filed Oct. 25, 2012, Smith.

* cited by examiner

*Primary Examiner* — Rachel R Steitz

(57) ABSTRACT

A cosmetic organizer comprising in combination a solid base and a cosmetic package having affixed thereto a fastener. The solid base has a surface cover affixed to it. A top surface of the surface cover is one-half of a hook and loop fastener or one-half of a mechanical micro-fastening system employing a plurality of mating nanoscale fastening elements. There is at least one cosmetic package having affixed thereto a fastener wherein a top surface of the fastener is a fabric complement of a hook and loop fastener or a mechanical micro-fastening system employing a plurality of mating nanoscale fastening elements. A bottom surface of the fastener has an adhesive for attaching the fastener to a cosmetic package.

3 Claims, 2 Drawing Sheets

COSMETIC ORGANIZER

This application is a continuation-in-part of U.S. patent application Ser. No. 13/659,951, filed Oct. 25, 2012.

BACKGROUND OF THE INVENTION

Ladies are well-known for their use of myriad cosmetics that are packaged in various packages including very small packages to very large packages. One major problem with such an array of cosmetic packaging is the lack of ability of being able to keep such packages organized such that they are handy and readably useable. Many times, the cosmetics are stored in drawers, cosmetic table tops and cupboards and are dispersed over a large number of such areas such that one has to a actually collect such cosmetics in order to be able to easily use them What is needed is a means of organizing the cosmetic packages so that they are handy and readily available to the user. The device of this invention provides such an organizer.

The applicant is aware of one cosmetic organizer that is set forth in U.S. Pat. No. 6,189,698, that issued Feb. 20, 2001 to Asser in which there is disclosed a cosmetics organizer comprising a palette, hook and loop fasteners having mating halves, andth side of at least one cosmetic item removably secured to the organizer by hook and loop fastener one individual mating half of each fastener is secured to the palette and the other individual mating half is secured to the cosmetic packaging.

In other words, a small portion of one-half of the hook and loop is secured to the cosmetic package and essentially an identical mating half small portion of the hook and loop is secured to the organizer, as opposed to the instant invention in which the entire surface of the organizer is covered with one-half of the hook and loop fabric allowing placement of the cosmetic package anywhere on the organizer without having to match patches of the fabric mounted on the organizer. Both sides of the base in the instant invention are completely covered by one of the hook or loop fasteners.

Other organizers that the applicant is aware of are U.S. Pat. No. 6,561,240, that issued on May 13, 2003 to Ma, dealing with a purse organizer U.S. Pat. No. 6,739,345, that issued on May 25, 2004 to Stanley, dealing with a makeup application kit; U.S. Pat. No. 6,820,744, that issued Nov. 23, 2004 to Hoffman, dealing with a skin product delivery system; U.S. Pat. No. 7,854,317 that issued on Dec. 21, 2010, dealing with a personal item organizer; U.S. Pat. No. 7,945,425, that issued on May 24, 2011 to Burnett, and U.S. Pat. No. 8,225,829, that issued on Jul. 24, 2012 to Melamed dealing with a transferable purse organizer, all of which are of interest but do not make the instant invention obvious, or do not anticipate the instant invention.

THE INVENTION

Thus, what is disclosed and claimed herein is a cosmetic organizer organizer comprising in combination a solid base and a cosmetic package having affixed thereto a fabric fastener. The solid base has a surface cover affixed to it. A top surface of the surface cover is a fabric one-half of a fabric hook and loop fastener. There is at least one cosmetic package having affixed thereto a fabric fastener wherein a top surface of the fabric fastener is a fabric complement of the fabric hook and loop fastener. A bottom surface of the fabric fastener has an adhesive for attaching the fabric fastener to a cosmetic package.

DETAILED DESCRIPTION OF THE INVENTION

Figure 1:
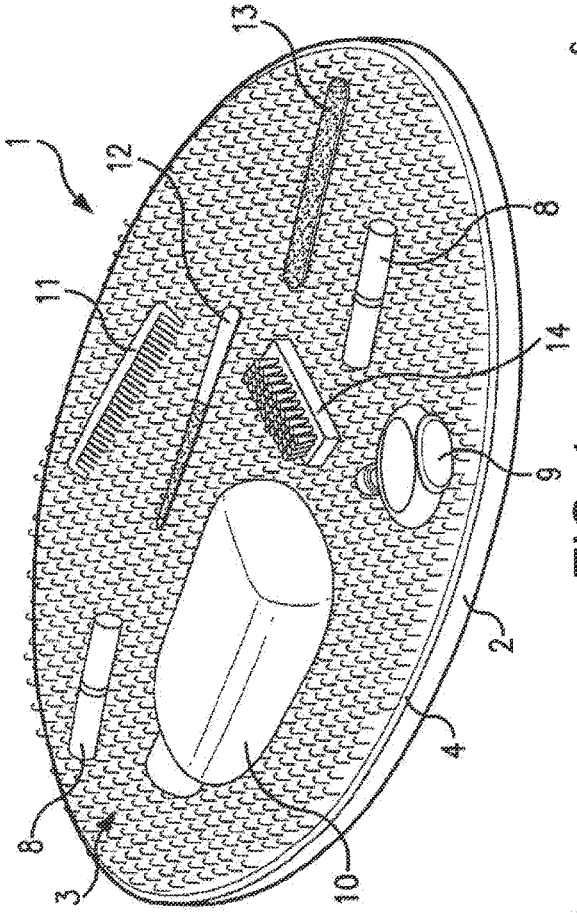
FIG. 1 is a full view in perspective of a device of this invention.

Turning now to FIG. 1, which is a full view in perspective of a device 1 of this invention, there is shown a base 2, and mounted on the entire top surface of the base 2 is a fabric one-half of a fabric hook and loop fastening means. The fabric as purchased commercially is purchased in two halves that conform to each other and are known commercially as Velcro® (Velcro is a registered trademark of the Velcro Company, Manchester, N.H., USA). Velcro consists of two components, typically, two lineal fabric strips, or alternatively, round dots or squares which are attached, that is sewn or adhered, to the opposing surfaces to be fastened. However, in the instant invention, the entire top surface of the solid base is covered with such a fabric. Another product that is useful in this invention is a material identified as Dual Lock™, a registered trademark of the 3M company. Yet another material that is useful in this invention is a material identified by the term Geloc. A description of Geloc can be found in U.S. Pat. No. 7,181,811, that issued on Feb. 27, 2007 to Tomanek, et al. The material is a mechanical micro-fastening system employing a plurality of mating nanoscale fastening elements.

In the claims herein, what is meant by the phrase "the fabric fastener is a fabric complement of said fabric hook and loop fastener" is that if the hook component is on the top surface of the solid base, then the loop component is on the cosmetic package and when the loop component is on the top surface of the solid base, then the hoop component is on the cosmetic package.

Figure 2:
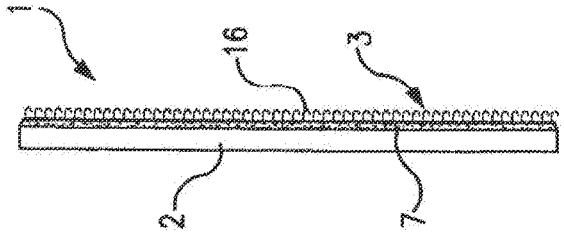
FIG. 2 is a full end view of the device of FIG. 1.
Figure 4:
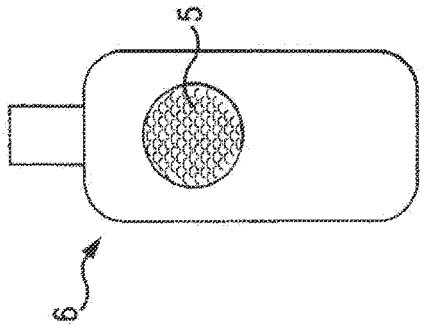
FIG. 4 is a cosmetic bottle showing the attachment of the device of FIG. 3A.

In the case of this invention, one half, for example, the hook component 3 is manufactured by adhering the fabric to the surface of a solid base 2, thus eliminating the need to adhere a fabric half of a Velcro system to a solid substrate by the user. See FIG. 2 which is a full end view of the solid base 2 with the hook component 3 fabric adhered by an adhesive 7. Also shown in FIG. 2 are the hooks 16. The other half, or the loop component 5 is secured to the cosmetic package 6 shown, for example, in FIG. 1 and FIG. 4 using adhesive 7 as shown in FIG. 2. The solid base 2 can have any shape, such as square, round, rectangular, octagonal, etc.

Figure 3B:
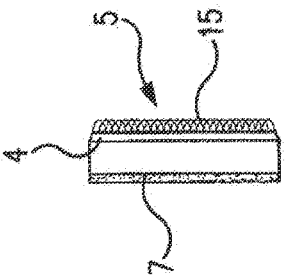
FIG. 3B is a full end view of FIG. 3A.
Figure 3A:
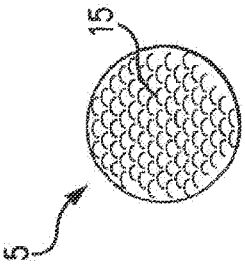
FIG. 3A is a full top view of a fastener of this invention.

FIG. 3A is a full top view of the loop component 5 and FIG. 3B shows a full end view of FIG. 3A showing the fabric 4, the loops 15 and the adhesive 7. It should be understood by those skilled in the art that the loop component 5 can be manufactured on the solid base 2, as well. Also, it should be understood by those skilled in the art that component 5 can be manufactured with self stick adhesive and such a component would then have a covering for such adhesive that would be removed when applying the loop component 5 to a cosmetic package.

FIG. 1 shows an array of cosmetic packages such as lipsticks 8, perfume 9, lotion 10, as well as other cosmetic needs, for example, a comb 11, a nail file 12, an emery board 13, and a nail brush 14. It contemplated within the scope of this invention to also fit jewelry onto the solid base 2 by the same construction.

Figure 5:
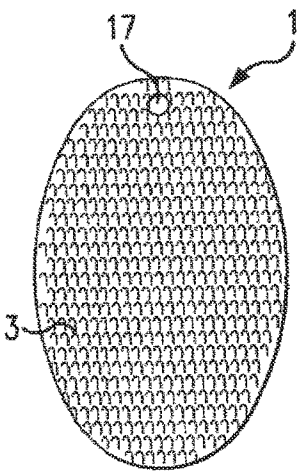
FIG. 5 is a full top view of a device of this invention showing an opening near one end.
Figure 6:
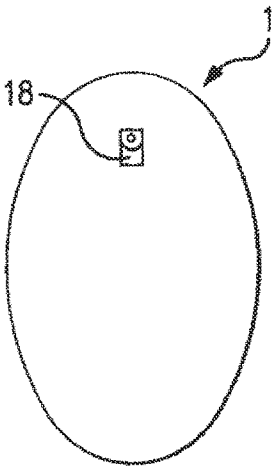
FIG. 6 is a full bottom view of a device of this invention showing a mechanical fastener.
Figure 7:
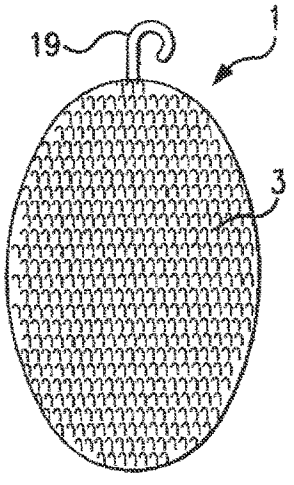
FIG. 7 is a full top view of a device of this invention showing a hook for hanging the device on a rod or hook.

The device of this invention also be mounted on a wall, box top, cupboard door and a shower rod, and the like, for convenience. Mounting on a wall or door can be accomplished by providing an opening 17 in the organizer as shown in FIG. 5 or by mechanical fasteners 18 as shown in FIG. 6. In addition, the organizer can be hung on a shower rod by providing a hook 19 as is shown in FIG. 7.

Figure 8:
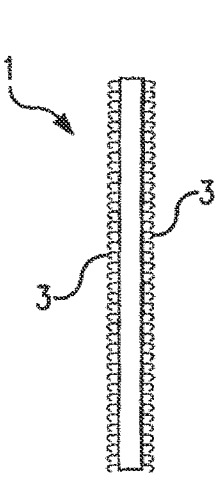
FIG. 8 is a full end view of a device of this invention showing the hook component on both side of the solid base.

It is contemplated within the scope of this invention to provide solid base 2 with hook components 3 on both sides of the solid base 2 as shown in FIG. 8 and in addition, it is contemplated within the scope of this invention to provide a solid base 2 with loop components 5 on both sides of the solid base 2.

Figure 9:
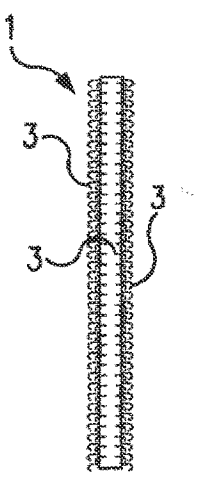
FIG. 9 is a full end view of a device of this invention showing the hook component on the entire surface of the solid base.
Figure 10:
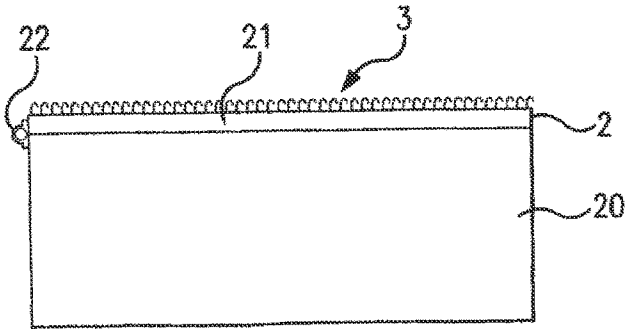
FIG. 10 is a full side view of a box having a top that is the solid base of this invention with a surface of hook components.
Figure 11:
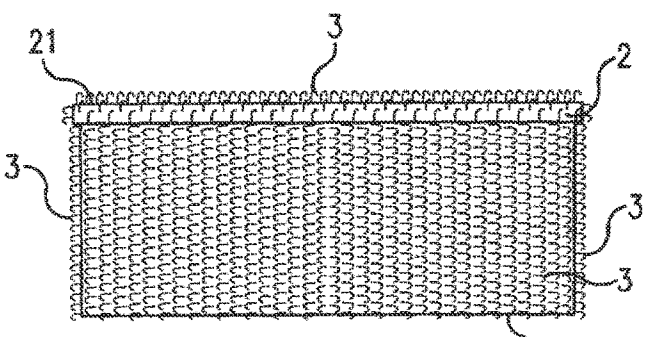
FIG. 11 is a full side view of a box entirely covered with a one-half of a fabric hook and loop fastener.

Further, the solid base 2 can also be provided with hook components 3 on all surfaces of the solid base 2, as shown in FIG. 9, or loop components 5 on all surfaces of the solid base 2. It is contemplated within the scope of this invention to provide a box 20 as shown in FIG. 10 wherein the top of the box 20 is a solid base 2 of this invention covered with either hook components 3 or loop components 5. The top 21 of the box 20 can be removable, or the top 21 can be hinged, for example, as shown in FIG. 10 wherein the hinge is denoted by the number 22. The solid base 2 can be manufacture from rigid, semi-rigid or soft materials. FIG. 11 is a full side view of a box entirely covered with a one-half of a fabric hook and loop fastener.

The device of this invention provides a system in which makeup does not break apart from bouncing around in a traditional makeup bag. It is more convenient for the purchaser, because the solid base 2 is manufactured with the entire surface covered with either hook component 3 or loop component 5.

One can easily determine makeup inventory because one can readily see there is something missing from the organizer upon a glance. This device provides a means of being able to keep one's cosmetics separate from the cosmetics of others. Further, it is not necessary for one to remove the cosmetics from the organizer to use the cosmetics and the device avoid the problems associated with dropping cosmetics or makeup when used in a moving vehicle such as a car, airplane or train.

What is claimed is:

1. A cosmetic organizer comprising in combination:

a solid base, said solid base having a surface cover affixed thereto, wherein the front and back of the solid base are entirely covered with one-half of a hook and loop fastener;

at least one cosmetic package having affixed thereto a fastener wherein a top surface of the fastener is a complement of said hook and loop fastener;

a bottom surface of said fastener having an adhesive for attaching said fastener to a cosmetic package.

2. A cosmetic organizer as claimed in claim 1 wherein the entire surface of the solid base is entirely covered with one-half of a hook and loop fastener.

3. A cosmetic organizer as claimed in claim 1 wherein the covered solid base forms the top of a box.

* * * * *